US005178052A

United States Patent [19]

Hansen

[11] Patent Number: 5,178,052

[45] Date of Patent: Jan. 12, 1993

[54] MACHINE FOR CUTTING IN ITEMS OF ELASTIC MATERIAL

[75] Inventor: Jan U. Hansen, Rodvig, Denmark

[73] Assignee: Hyma Engineering A/S, Havdrup, Denmark

[21] Appl. No.: 682,564

[22] Filed: Apr. 9, 1991

[30] Foreign Application Priority Data

Apr. 11, 1990 [DK] Denmark ..... 0935

[51] Int. Cl.[5] ..... B26D 1/46

[52] U.S. Cl. ..... 83/796; 83/452; 83/651.001; 83/801; 83/811

[58] Field of Search ..... 83/171, 561.1, 307.1, 83/613, 452, 796, 797, 801, 810, 811, 813

[56] References Cited

U.S. PATENT DOCUMENTS 4,059,035 11/1977 Davis ..... 83/768

4,077,301 3/1978 Brahm ..... 83/651.1

FOREIGN PATENT DOCUMENTS 1265398 4/1968 Fed. Rep. of Germany ..... 83/171

2800902 11/1978 Fed. Rep. of Germany ..... 83/171

*Primary Examiner*—Hien H. Phan

[57] ABSTRACT

By means of a cutting machine according to the invention, the cutting of blocks of foam rubber can be effected in a more precise, less energy-demanding and at the same time less space-demanding manner compared to the known machines. This is achieved by a cutting arrangement which is supported by rocker arms (6), so that the cutting arrangement is balanced in the support, whereby only a small amount of energy is required to tilt the cutting arrangement and herewith the cutting blade (2) up and down during the cutting operation. The guide rails (4) for the control of the cutting blade (2) can be adjusted in such a manner that the cutting plane (9) of the machine can be inclined for diagonal cutting.

12 Claims, 3 Drawing Sheets

MACHINE FOR CUTTING IN ITEMS OF ELASTIC MATERIAL

BACKGROUND OF THE INVENTION

The invention relates to a machine for cutting in items of elastic material, of rubber or synthetics, for example blocks of foam rubber, said machine comprising a holding arrangement for the item in the form of a pair of jaws on each side of the item in its cutting position, and a cutting arrangement in the form of a cutting blade driven over wheels by a motor and being mounted in a frame which can be moved in a sliding manner on guide rails for the control of the cutting blade when said blade is being fed through the item by the movement of said frame.

Machines of this kind are used especially within the foam material industry for cutting through blocks of foam rubber when these blocks are to be shaped after the foaming process and the hardening.

Known cutting machines are usually built up of a frame with vertically extending guide rails or columns on which a frame with the cutting arrangement, in the form of a cutting blade, rollers and motor, can be raised and lowered for the movement of the free part of the cutting blade through the block.

With these constructions, however, the whole of the frame must be raised and lowered, which requires not only a considerable amount of energy, but also an expensive mechanical configuration in order to be able to ensure a precise movement of the frame and the cutting blade.

This precise movement is namely a precondition for the cutting to be effected in a completely uniform manner, and thus for the cut to be uniformly plane. Moreover, the machines have a relatively large construction height in relation to their cutting height, with the additional result that the machines become very heavy and costly to produce, to transport, to install and to operate.

BRIEF DESCRIPTION OF THE INVENTION

It is the object of the invention to remedy these inconveniences and disadvantages of the known machines, and this object is achieved with a machine in which the frame, at that end where the cutting blade extends freely between the frame's opposite sides, is coupled to a carriage which can slide on guide rails which are mounted in a plane parallel to the cutting plane of the cutting blade, and further where the sides of the frame are coupled to a support having an axis of rotation which extends parallel to the cutting plane, so that during the cutting process the frame can be moved along the guide rails supported by and turning around the axis.

In a simple manner, the solution achieved hereby is one where a part of the frame is supported, so that it is solely the remaining part of the frame which needs to be moved up and down on the guide rails during the cutting. The need for guide rails and columns is reduced to comprise only two rails near the cutting plane. This considerably reduces the mechanical constructions, in that the frame is now only required to be able to swing around its axis of rotation during the cutting operation. Consequently, the control of the frame can be simplified to comprise only a forwards and backwards movement of two carriages on two guide rails.

Furthermore, the suspended support will result in a much better control of the frame, the reason being that the bearings can control the frame in all positions, whereby the slides are relieved of transverse influences. The construction of the frame and the support can thus be considerably simplified, so that the machine becomes lighter and very precise cutting, and moreover requires a very low consumption of energy. The height of the machine can also be reduced to be only slightly greater than its cutting height. This provides the possibility of assembly in premises with relatively low headroom.

By mounting the frame in a balanced manner in the axis of rotation in the suspension, the energy requirement will be the least possible, namely merely that required to ensure the rate of movement of the carriages on the guide rails during the cutting.

Also, by supporting the frame on arms which can swing in relation to the support, the construction becomes very simple, and the torsion to which the cutting blade is subjected in its lower cutting position will be limited to a maximum of 45°.

Further, by being able to adjust the guide rails, the cutting plane can be adjusted from right-angled to diagonal cutting.

Finally, it is expedient to suspend the frame close to the support, in that the machine hereby becomes very compact and assumes a very low center of gravity.

BRIEF DESCRIPTION OF THE DRAWINGS

The invention will now be described in more detail with reference to the drawing, where.

DETAILED DESCRIPTION OF THE INVENTION

Figure 1:
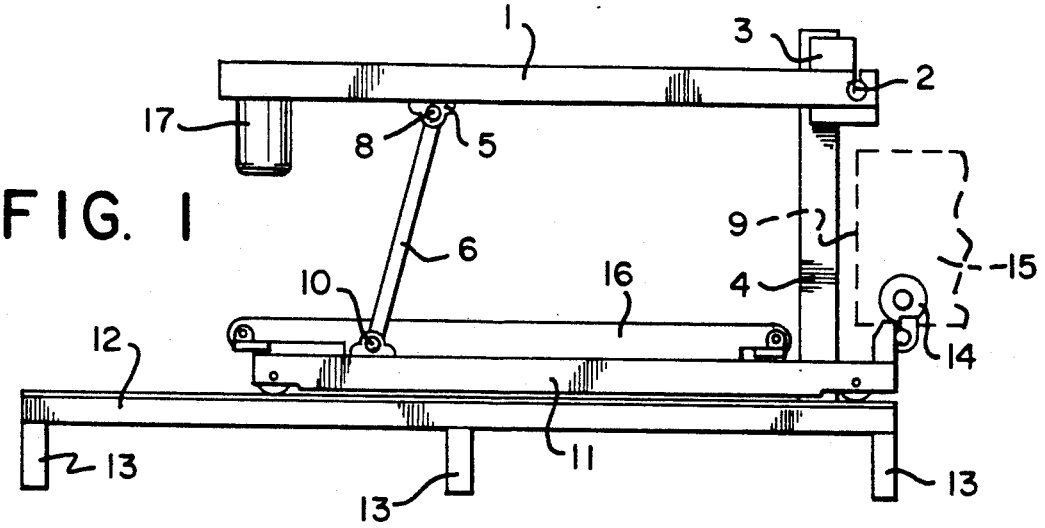
FIG. 1 shows a cutting machine seen from the side in its start position before the cutting.

In the drawing are shown some examples of preferred embodiments of cutting machines.

Figure 2:
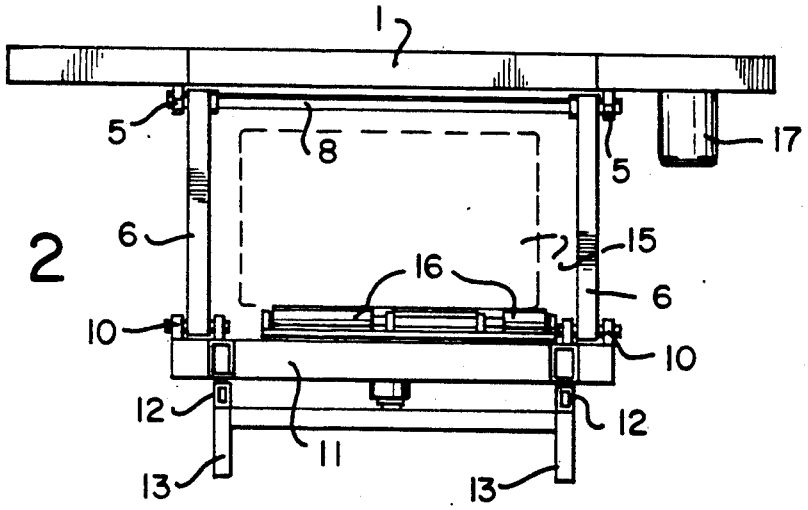
FIG. 2 shows the machine seen from its delivery side.
Figure 3:
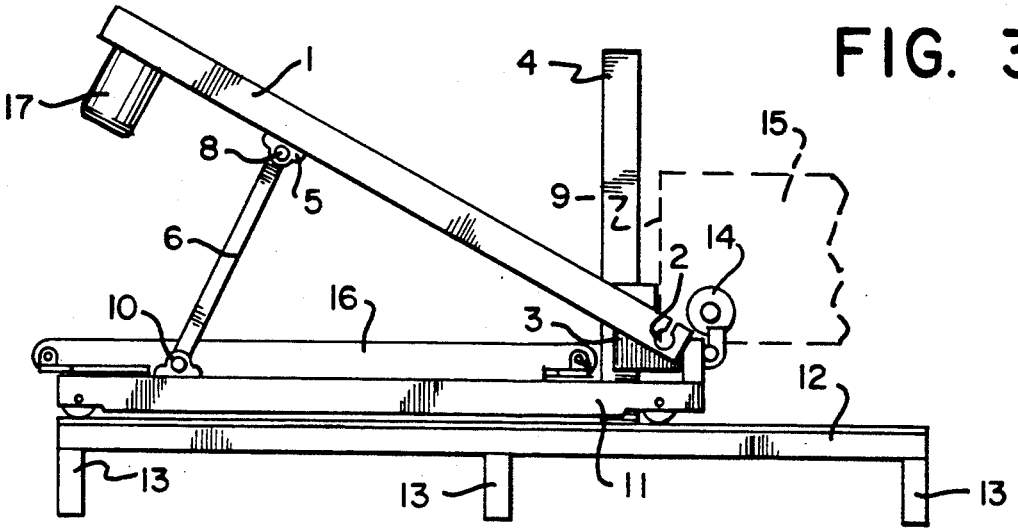
FIG. 3 shows the machine after the cutting operation.

One embodiment, which is shown in FIGS. 1–3, has a bedframe comprising longitudinal running-rails 12 which rest on feet 13.

On the running-rails there is disposed a carriage 11, so that the carriage 11 can move forwards and backwards on the rails 12.

The carriage 11 forms the support for a pair of oppositely-facing jaws 14 which, by means of commonly-known actuators, can be moved inwards and outwards in relation to the carriage 11. A foam rubber block 15, which is indicated by stippled lines, will thus be able to be secured between the jaws 14, and with the feeding forward of the block 15 will cause the whole of the carriage 11 to be moved on the bedframe's running rails 12.

On the carriage 11 there is also mounted one or more conveyors 16 which serve to convey the foam material which has been cut from the block 15 out of the machine.

The carriage also has an upwardly extending guide rail 4 mounted in two of its corners, said rails being provided with a chain drive (not shown) for the raising and lowering of slides 3 which run on the guide rails 4.

The cutting arrangement itself comprises a frame 1 which extends from the slide 3 and along the sides of the carriage 11 and terminates in a cross-frame. In the corners of the frame are mounted wheels (not shown), one of which is driven by a motor 17. On these four wheels there runs an endless cutting blade 2. A cutting wire can be used instead of a cutting blade.

On the frame 1 there is also mounted bearings 5 at that point on the frame at which it is in balance. The result of the weight of the motor 17 is that the line of equilibrium 8 lies closer to this in relation to the center of the frame.

Extending through the bearings 5 there is a pivot shaft or spindle 8 which also has bearing connections with the ends of two support arms 6, the lower ends of which being linked to the carriage 11 in such a manner that the arms 6 are slightly inclined, as shown in FIGS. 1 and 3.

By balancing the cutting arrangement in such a manner, only a small amount of energy is required for the chain drive in the guide rails 4 to move the slides 3 up and down on the rails.

During the upwards and downwards movement of the slide 3, the frame 1 pivots around its bearing 5, and the arms 6 swing slightly around their lower bearings 10, but in such a manner that the frame is still more or less in balance.

The cutting blade 2 extends at right-angles to the direction of movement of the slides 3, so that when the machine is in its start position, as shown in FIGS. 1 and 2 in which the frame is raised, the blade is not loaded. Since this is at the same time the machine's position of rest, for most of the time the blade is unloaded with regard to torsion in this position.

During the cutting operation, the frame is lowered to the position shown in FIG. 3, while the blade 2 cuts through the block 15 in a section 9, while at the same time the slide-guide 18 holds the blade 2 at right-angles in relation to the cut-section 9, so that in its lowest position the blade is twisted a maximum of about of 45° in relation to the start position. However, this is not detrimental to the blade, since the twisting occurs only briefly.

Immediately after the cutting operation, the frame 1 is tipped up again and hereafter assumes its start position, as shown in FIGS. 1 and 2.

The jaws 14 can hereafter be released and the carriage 11 takes up a new position in relation to the block 15, after which the jaws 14 can again be activated and a new cutting operation can be carried out.

Figure 4:
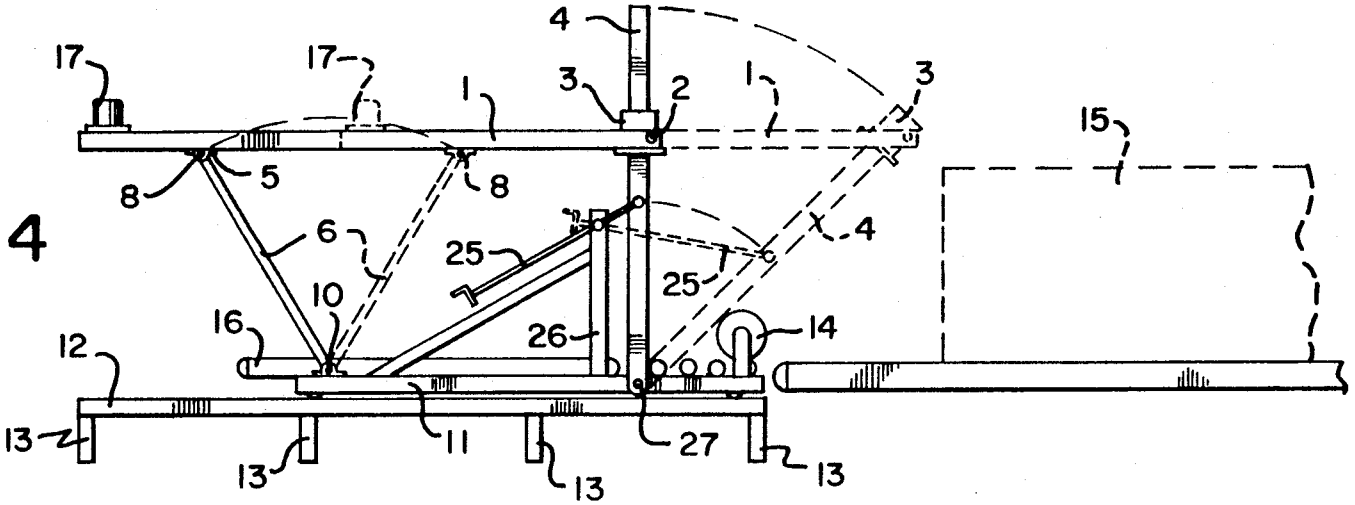
FIG. 4 shows the machine provided with means for the adjustment of the cutting angle in the machine's start position.
Figure 5:
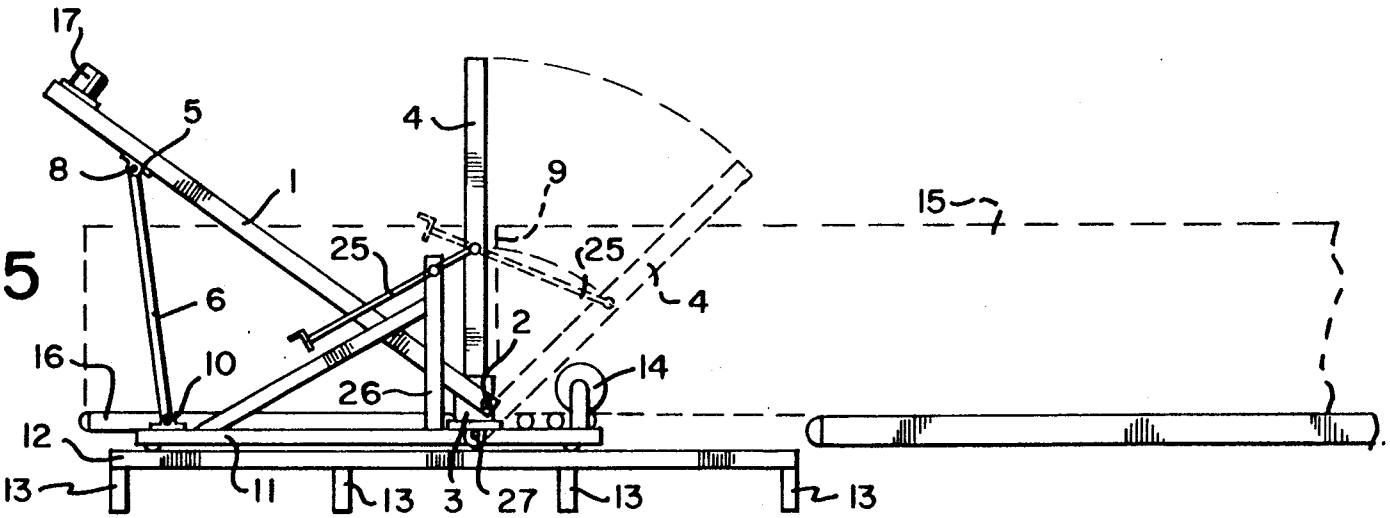
FIG. 5 shows this machine after the cutting operation.

As shown in FIGS. 4 and 5, the machine can be provided with means for adjustment of the cutting angle.

These means comprise a lower pivotal coupling 27 of the guide rails 4 to the carriage 11, so that the rails can swing outwards at a given angle as indicated by stippled lines.

For the securing of the rails 4 in their desired angular position, on the carriage 11 there is mounted a post 26 which is provided with a threaded bush into which a shaft 25 is screwed, the outer end of said shaft being coupled to the rails 4. By suitable means, for example a handle on the end of the shaft 25, the rails can be adjusted into any desired position within a given maximum from the vertical, for example 45°.

It should be noted that the support arms 6 slope slightly away from the cutting plane 9, so that the cutting arrangement can be supported even in the machine's maximum outwardly-adjusted position, as indicated by stippled lines in FIG. 4.

In this manner it is possible to effect diagonal cuts, which provides possibilities for the production of improved foam material products. It will thus be possible to glue several layers together to form a laminated block, which by diagonal cutting in the machine thereafter will have a greater surface and also better strength characteristics due to the larger glue area.

Figure 6:
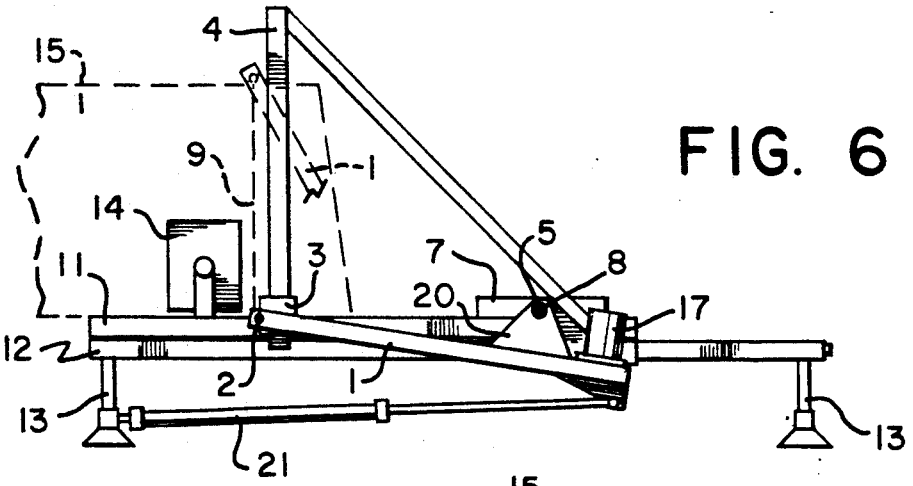
FIG. 6 shows a second embodiment of the cutting machine seen from the side in the start position before the cutting operation.
Figure 7:
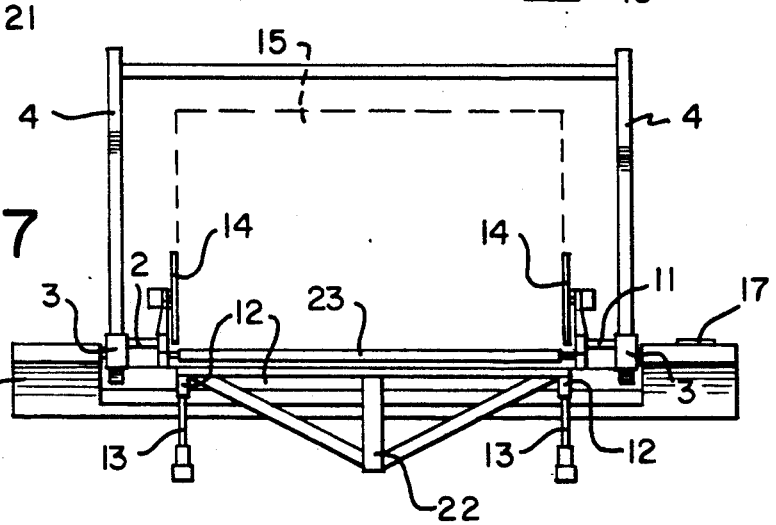
FIG. 7 shows this embodiment seen from the feeding end.
Figure 8:
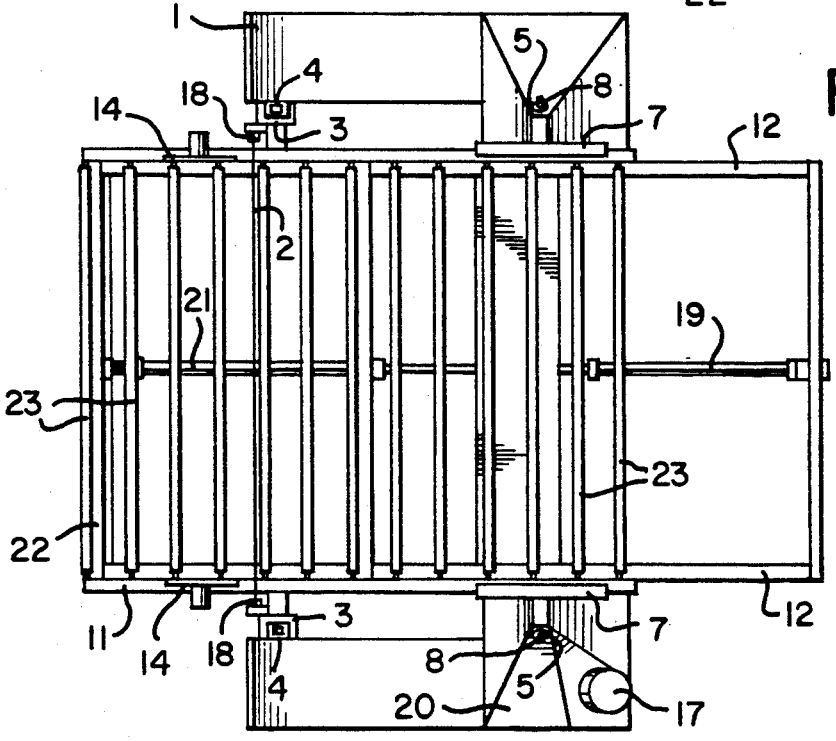
FIG. 8 shows this embodiment seen from above.

In FIGS. 6–8 is shown an example of a further embodiment of the cutting machine.

The carriage 11 is provided with a bearing base 7 which can be moved a distance forwards and backwards on the carriage, possibly damped by a gas cylinder 19.

On the bearing base 7 there are mounted bearings 5 with a through-going axis of rotation 8, around which a suspension 20 for the frame 1 is coupled so that the frame 1 lies a distance below the axis of rotation 8, and such that the frame's line of equilibrium extends below the axis 8.

Suspended in such a manner, the chain drive in the guide rails 4 is easily able to raise and lower the guide slide 3 and herewith the cutting blade 2.

A block of foam material 15 secured by the jaws 14 will now be able to be cut through in a section 9 by the movement of the frame 1 and therewith the blade 2 up to the position indicated by the stippled line in FIG. 4 and down again to the position of rest.

During this pivoting of the frame 1, the bearing base 7 on the carriage is moved in order for the frame to move in a linear manner on the guide rails 4.

Instead of a chain drive in the guide rails 4, an operating cylinder 21 can be mounted under the base 12, 13 in an under-frame 22, and the piston rod can be secured by a link 24 to the cross-piece of the frame 1, so that a retraction of the piston rod by the cylinder 21 will cause the frame 1 to swing upwards. Correspondingly, when the piston rod is extended, the frame will be lowered.

Instead of a conveyor belt, the transport table on the carriage 11 can be configured as a roller conveyor 23.

I claim:

1. A machine for cutting clocks of material comprising:

a pair of vertical guide rails mounted on a base between which the blocks pass, a frame having a carriage at one end for moving along said guide rails, said carriage carrying means for cutting the material of a block, and an elongated support member, means for coupling one end of said support member to said frame at a point spaced from the carriage and the other end to said base with said coupling means including a pivot at one end of said support member to permit said frame to rotate about an axis on said one support member end, vertical movement of said carriage and the cutting means thereon on said vertical guide rails rotating said frame about said pivot while being supported by said support member.

2. Machine according to claim 1, wherein said support member comprises a pair of spaced arms, the pivot of said coupling means being mounted on said pair of support arms at the end connected to the frame, said arms having a length which corresponds substantially to the travel length of the carriage on the guide rails.

3. Machine according to claim 2 wherein said support member comprises a pair of spaced rails, said support member comprising a pair of support arms, and connected to each of said rails, said coupling means mounted on said pair of support arms, said arms having a length which corresponds substantially to the travel length of the carriage on the guide rails.

4. Machine according to claim 2, wherein the guide rails are pivotal in relation to the base for the adjustment of the angle of cut of the cutting means with respect to the base.

5. Machine according to claim 2, wherein the coupling means of the support member is pivotable both with respect to the frame and the base.

6. Machine according to claim 1, wherein said support member comprises a pair of spaced rails, said support member comprising a pair of support arms, and connected to each of said rails, said coupling means mounted on said pair of support arms, said arms having a length which corresponds substantially to the travel length of the carriage on the guide rails.

7. Machine according to claim 6, wherein the guide rails are pivotal in relation to the base for the adjustment of the angle of cut of the cutting means with respect to the base.

8. Machine according to claim 1 wherein the guide rails are pivotal in relation to the base for the adjustment of the angle of cut of the cutting means with respect to the base.

9. Machine according to claim 1, wherein the coupling means of the support member is pivotable both with respect to the frame and the base.

10. Machine according to claim 1 further comprising motor means for driving said carriage on said guide rails.

11. Machine according to claim 1 further comprising a pair of jaw means for clamping and holding the block relative to said guide rails.

12. Machine according to claim 1 wherein the pivot of said coupling means is at the end of the support member connected to the frame.

* * * * *